US006874585B2

(12) United States Patent
Zhao

(10) Patent No.: US 6,874,585 B2
(45) Date of Patent: Apr. 5, 2005

(54) POWER DRILL

(75) Inventor: Kong Zhao, Suzhou (CN)

(73) Assignee: Positec Power Tools (Suzhou) Ltd., Suzhou (CN)

( * ) Notice: Subject to any disclaimer, the term of this patent is extended or adjusted under 35 U.S.C. 154(b) by 0 days.

(21) Appl. No.: 10/830,765

(22) Filed: Apr. 23, 2004

(65) Prior Publication Data

US 2004/0211577 A1 Oct. 28, 2004

(30) Foreign Application Priority Data

Apr. 23, 2003 (CN) ..... 03221476 U

(51) Int. Cl.[7] ..... B25D 11/00
(52) U.S. Cl. ..... 173/48; 173/178; 173/216
(58) Field of Search ..... 173/48, 109, 216, 173/217, 178, 201

(56) References Cited

U.S. PATENT DOCUMENTS 5,451,127 A * 9/1995 Chung ..... 408/20
6,142,242 A * 11/2000 Okumura et al. ..... 173/48
6,152,242 A * 11/2000 Chung ..... 173/48
6,196,076 B1 * 3/2001 Chung ..... 74/22 A
6,202,759 B1 * 3/2001 Chen ..... 173/48
6,688,406 B1 * 2/2004 Wu et al. ..... 173/48

* cited by examiner

*Primary Examiner*—Scott A. Smith
(74) *Attorney, Agent, or Firm*—Jenkens & Gilchrist, P.C.

(57) ABSTRACT

The present invention relates to a power drill which comprises a spindle and a rear bearing mounted on the rear portion of the spindle. A fixed gear wheel is connected to a gearbox and a movable gear wheel is connected to the spindle. An adjustment member is provided on the front portion of the spindle. The adjustment member comprises an adjustment cover, an adjustment fork connected to the adjustment cover and a sleeve connected to the adjustment fork and mounted on the front end of the spindle. On the sleeve is provided a groove. A stroke adjustment member on which is provided a protruding block is disposed between the movable gear wheel and the sleeve. A stopper whose radial dimension is greater than the spindle is disposed on the front portion of the spindle. A plane bearing is disposed between the front end of the sleeve and the rear end of the stopper and is provided with a retainer for receiving a rolling element. The exterior periphery of the rolling element protrudes from the exterior periphery of the retainer.

12 Claims, 5 Drawing Sheets

POWER DRILL

CROSS REFERENCE TO RELATED APPLICATIONS

This application claims priority to Chinese Patent Application No. 03221476.6, filed Apr. 23, 2003, which is incorporated by reference herein in its entirety.

FEDERALLY SPONSORED RESEARCH STATEMENT

Not applicable.

REFERENCE TO MICROFICHE APPENDIX

Not applicable.

FIELD OF THE INVENTION

The present invention relates to a power drill with dual functionality (drill and hammer modes).

BACKGROUND OF THE INVENTION

Generally speaking, a conventional power drill comprises a spindle and a rear bearing mounted on the rear portion of the spindle. A fixed gear wheel is connected to a gearbox and a movable gear wheel is fixed to the spindle. An impact adjustment member provided on the front portion of the spindle comprises an impact adjustment cover, an impact fork connected to the impact adjustment cover and a sleeve connected to the impact fork. The front interior of the sleeve slidably contacts the exterior periphery of the spindle and is mounted on the front portion of the spindle. The impact sleeve is provided with a groove and a stroke adjustment member is disposed between the movable gear wheel and the sleeve. On the stroke adjustment member is a protruding block. A stopper is disposed on the front portion of the spindle. As disclosed in U.S. Pat. No. 6,202,759, U.S. Pat. No. B1-6,196,076 and U.S. Pat. No. 5,451,127, dispersed steel balls with retainers are used to reduce the friction between the impact adjustment member and the shoulder of the output axle. The resulting construction is complex with many parts and demands a large distance between the front end of the sleeve and the front end of the stopper. The larger radial runout of the output axle due to the bigger ratio L2/(L1+L2) (where L1 is the distance between the back end of the rear bearing and the front end of the sleeve and L2 is the distance between the front end of the sleeve and the front end of the stopper) results in an inaccurate diameter and reaming and difficulty in hole positioning.

SUMMARY OF THE INVENTION

It is an object of the invention to provide a power drill that is assembled easily and positioned accurately.

In accordance with the invention, there is provided a power drill which comprises a spindle and a rear bearing mounted on the rear portion of the spindle. A fixed gear wheel is connected to a gearbox and a movable gear wheel is connected to the spindle. An adjustment member is provided on the front portion of the spindle. The adjustment member comprises an adjustment cover, an adjustment fork connected to the adjustment cover and a sleeve connected to the adjustment fork. The front interior of the sleeve is in slidable contact with the exterior periphery of the spindle and is mounted on the front end of the spindle. On the sleeve is provided a groove. A stroke adjustment member on which is provided a protruding block is disposed between the movable gear wheel and the sleeve. A stopper whose radial dimension is greater than the spindle is disposed on the front portion of the spindle. A plane bearing is disposed between the front end of the sleeve and the rear end of the stopper. The plane bearing is provided with a retainer for receiving a rolling element. The exterior periphery of the rolling element protrudes from the exterior periphery of the retainer.

The one or more rolling elements are disposed in a retainer of simple structure between the front end of the sleeve and the rear end of the stopper so as to obtain a smaller radial runout of the output axle thereby allowing accurate positioning of the cutting element and less tendency to wander.

In a preferred embodiment the one or more rolling elements extend axially beyond the second axial end of the retainer.

In a preferred embodiment the retainer includes a first annular retaining wall connected to and positioned coaxially within a second annular retaining wall to confine the one or more rolling elements radially therebetween, wherein either or both of the first annular retaining wall and second annular retaining wall are adapted to confine axially the one or more rolling elements.

In a preferred embodiment the retainer defines one or more pockets for the one or more rolling elements.

In a particularly preferred embodiment the retainer comprises an annular main body incorporating the one or more pockets. Preferably the one or more pockets are a plurality of pockets distributed uniformly around the annular main body.

In a particularly preferred embodiment the annular main body has an outer circumference and an inner circumference, wherein the first annular retaining wall extends axially from the inner circumference and the second annular retaining wall extends axially from the outer circumference, wherein either or both of the first and second retaining wall are adapted to confine axially the one or more rolling elements. Preferably the second annular retaining wall is inwardly concave. Preferably the first annular retaining wall is outwardly concave.

Preferably the power drill further comprises a resilient biasing member connected between the stroke adjustment member and the sleeve for biasing them apart (ie they are normally axially separate).

In a preferred embodiment the first engaging portion is one or more radial grooves (eg two radial grooves) and the second engaging portion is one or more protruding blocks (eg two protruding blocks).

The adjustment fork may be an adjustment ring. In order to rotatably couple the rotary adjustment cover with the sleeve, the adjustment fork and sleeve (eg the front end of the sleeve) may be provided with engageable male and female portions. In a preferred embodiment, the adjustment fork comprises a ring with a plurality of radial arms (typically three radial arms) distributed (preferably substantially uniformly distributed) around its inner circumference. A washer may be deployed to resist axial movement of the adjustment fork relative to the sleeve. In a preferred embodiment the front end of the sleeve is provided with a plurality of notches engageable with the plurality of radial arms.

The stroke adjustment member may take the form of a ring with a plurality of legs (eg three legs) extending axially from its outer circumference. The legs may be substantially uniformly distributed around the outer circumference. The one or more protruding blocks may be uniformly distributed around the ring. Preferably the stroke adjustment member is mounted on the spindle such that the legs extend axially outside the exterior surface of the sleeve. Preferably the legs are captive between the gearbox and the housing or a fixed element (such as a clamp plate).

The collar on the front portion of the spindle is at or near to the front end of the spindle. Typically the front portion of the spindle terminates (eg beyond the front face of the stopper) in a threaded portion. The threaded portion may be threadedly engaged with the retaining member. The rear portion of the spindle may be adapted to engage the transmission assembly. For example, the rear portion may be provided with radial teeth.

Typically the cutting element is a drill bit or similar cutter. The retaining member is typically a chuck.

In accordance with an embodiment of the invention, there is provided a power drill comprising: a spindle, a rear bearing mounted on the rear portion of said spindle, a fixed gear with end tooth fixedly connected with a gearbox, a movable gear with end tooth fixedly connected with said spindle, an adjustment member mounted on a front portion of said spindle, said adjustment member comprising an adjustment cover, a fork connected with said adjustment cover, a sleeve connected with said fork, a front interior of said sleeve being slidely contacted with the exterior periphery of said spindle and said sleeve being mounted on said front portion of said spindle, said sleeve being provided with a groove, a stroke adjustment member being disposed between said movable gear with end tooth and said sleeve, said stroke adjustment member being provided with a protruding block, a stopper whose radial dimension is larger than and is disposed on the front portion of the spindle, characterized in that: said plane bearing is disposed between the front end of said sleeve and the rear end of said stopper, said plane bearing is provided with a retainer for receiving a rolling element, the exterior periphery of the rolling element protruding beyond the opposite exterior periphery of the retainer.

DESCRIPTION OF EMBODIMENTS OF THE INVENTION

Figure 1:
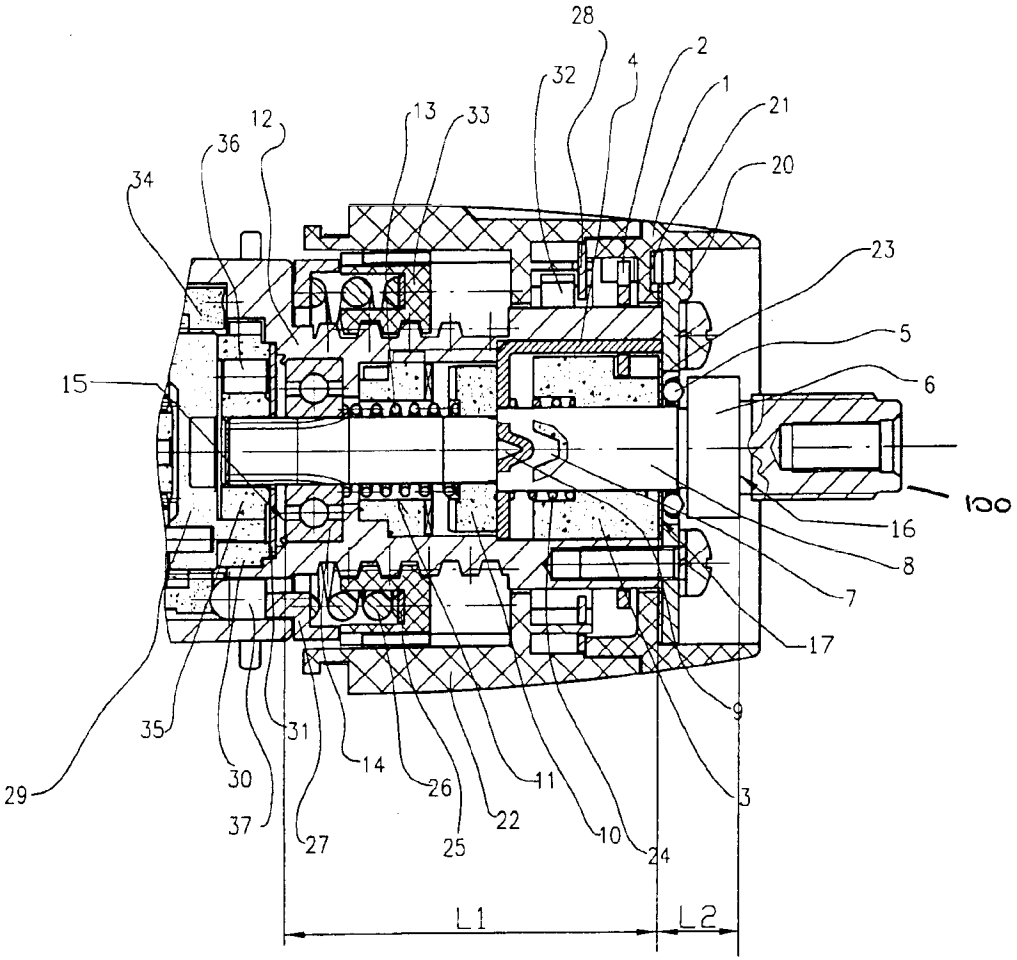
FIG. 1 is a partial front cross-sectional view of an embodiment of the present invention.
Figure 2:
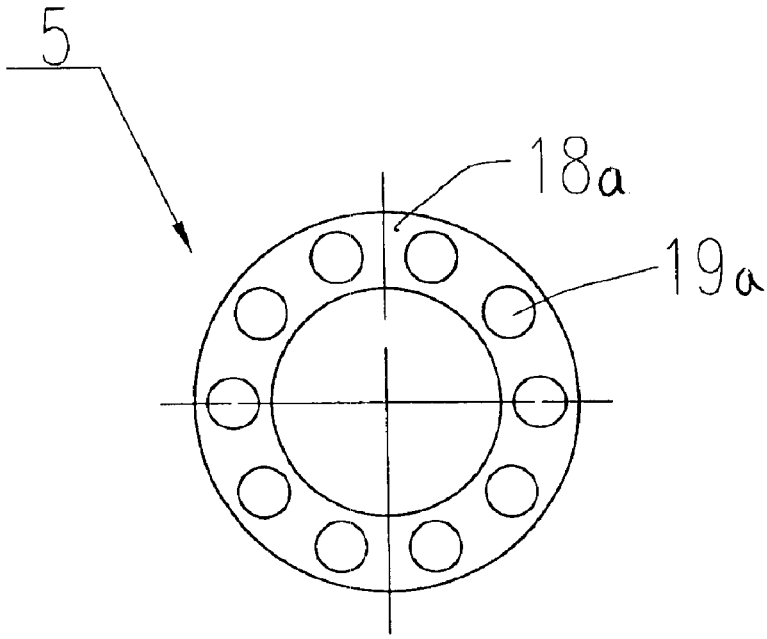
FIG. 2 is a front view of the plane bearing of the embodiment of the present invention.
Figure 3:
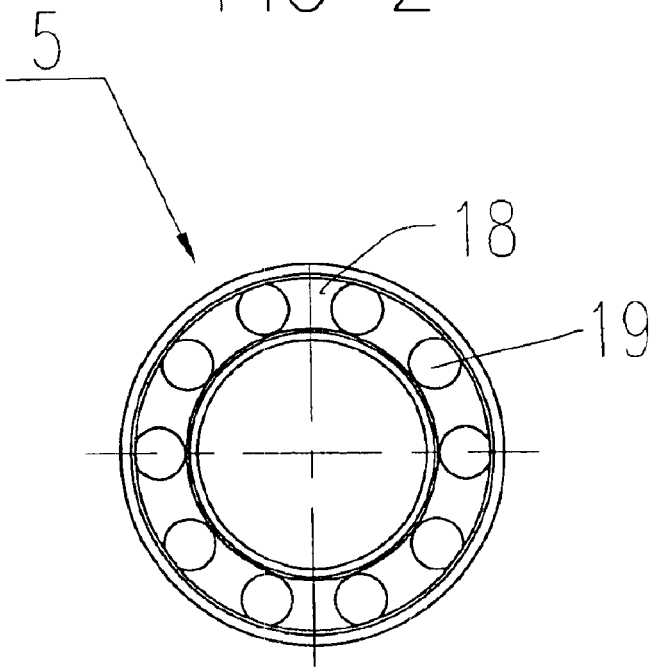
FIG. 3 is a rear view of the plane bearing of the embodiment of the present invention.
Figure 4:
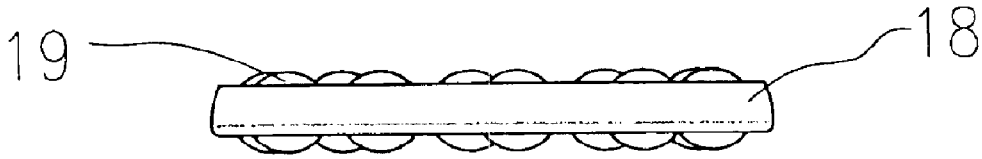
FIG. 4 is a top view of the plane bearing of the embodiment of the present invention.
Figure 5:
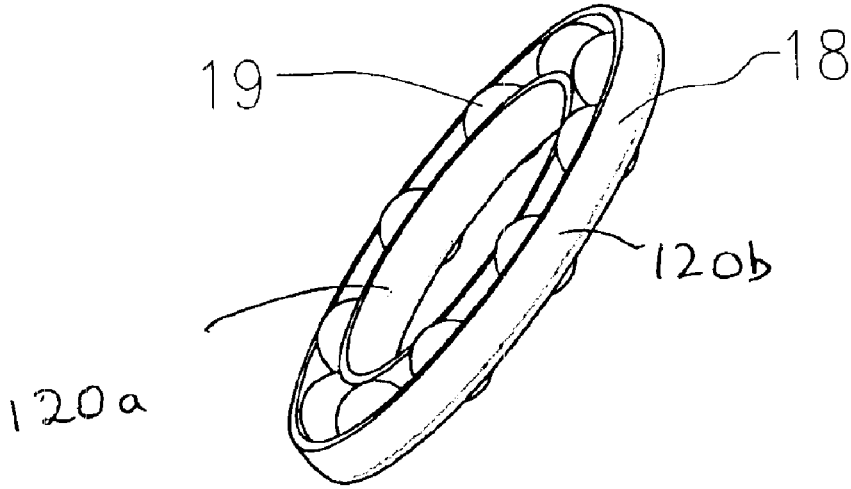
FIG. 5 is a perspective view of the plane bearing of the embodiment of the present invention.
Figure 6:
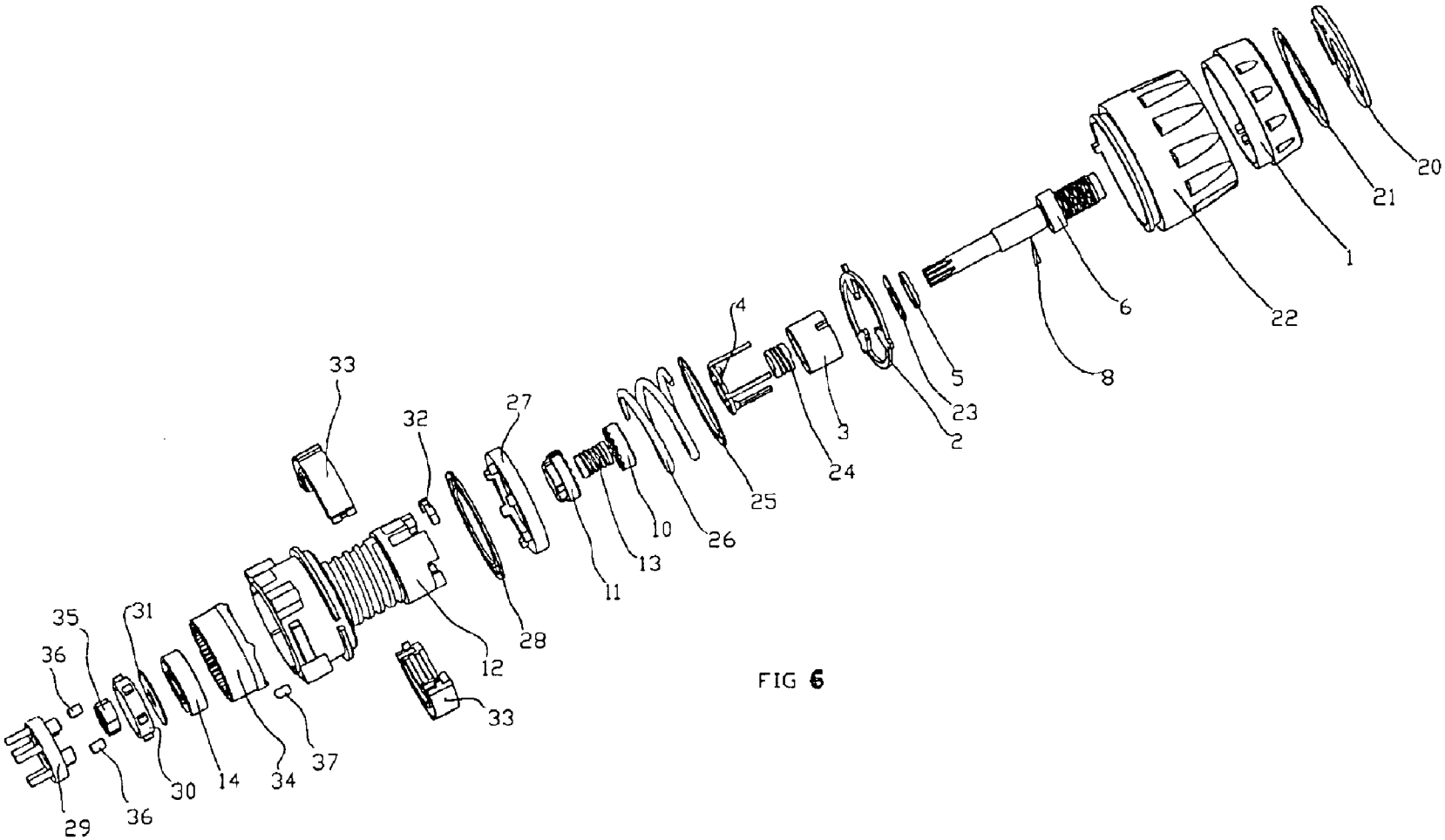
FIG. 6 is an exploded view of the embodiment of the present invention.
Figure 8:
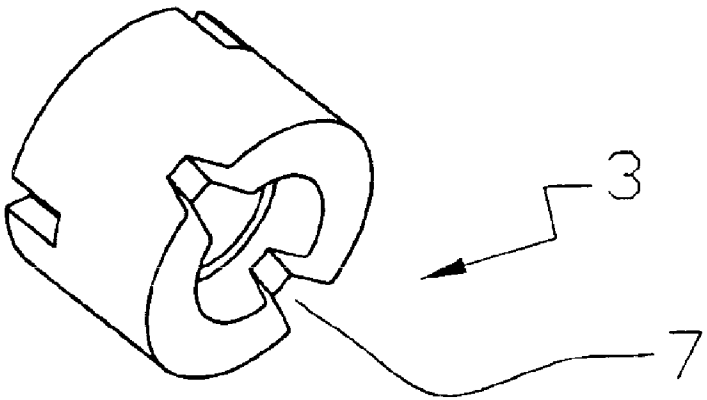
FIG. 8 is a perspective view of the sleeve 3 of the embodiment of the present invention.
Figure 7:
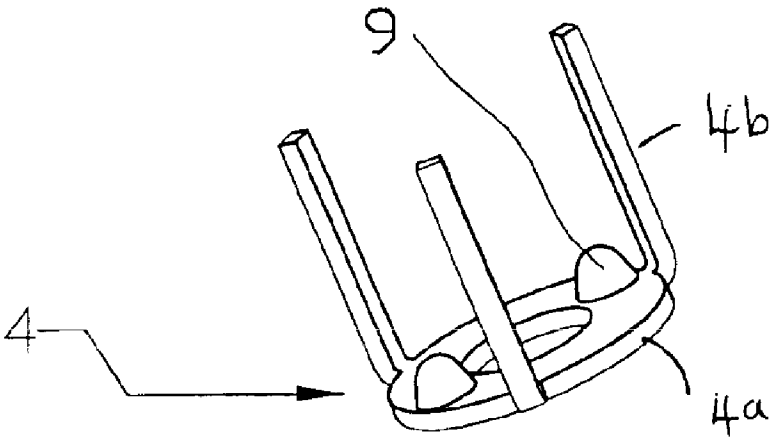
FIG. 7 is a perspective view of the stroke adjustment member 4 of the embodiment of the present invention.

Referring to FIGS. 1 to 8, a power drill with a drilling mode and a hammer mode comprises a drill housing (not shown) which houses the drill components described herein below and a chuck 100 which retains a cutting element such as a drill bit. A spindle 8 along the main axis of the housing outputs a torque in the drilling mode and a torque and impact force in the hammer mode to the chuck 100 and a rear bearing 14 is mounted on the rear portion of the spindle 8 for supporting the spindle 8. An integral collar on the front portion of the spindle 8 at the distal end of the housing serves as a stopper 6. The stopper 6 has a rear face which assists in positioning the drill components in the housing and a front face which supports the chuck 100 externally.

The spindle 8 is driven by a motor disposed internally at the rear portion of the housing and the rotation of the motor is transmitted to the spindle 8 by a transmission assembly which is accommodated within a gearbox 12 and which includes several gears (one of which is a ring gear 34). The rotation of the ring gear 34 is transmitted to a planetary rack 29 by several planet gears (not shown in the Figures) which engage the ring gear 34. A rotation transmitting member 35 has an external form which matches the planetary rack 29 and is driven by it. A large number of inner teeth are provided on the rotation transmitting member 35 and these engage with the spindle 8 and output the rotation to the chuck. A fixed reel 30 rings the rotation transmitting member 35 and a plurality of rollers 36 are provided between the rotation transmitting member 35 and the fixed reel 30. A washer 31 limits the mounting position of the rotation transmitting member 35, the fixed reel 30 and the rollers 36 within the gearbox 12. The fixed reel 30 cooperates with the rollers 36 to prevent the transmission assembly transmitting inversely.

A supporting ring 27 rings the gearbox 12 and its rear end presses against a supporting rod 37. The supporting ring 27 has a multiply recessed, round end held on the front end of the ring gear 34. A torque adjustment member 22 for adjusting the torque outputted by the spindle 8 is non-rotatably connected to two half nuts 33 screwed onto the gearbox 12. A torsion spring 26 is disposed between the supporting ring 27 and the half nut 33 in the axial direction. By rotating the torque adjustment member 22 to adjust the compression force of the torsion spring 26, the torque outputted by the spindle 8 will be effected. A washer 25 is deployed in contact with the torsion spring 26 to enhance the wear characteristics of the plastic half nuts 33.

A fixed gear 11 ringing the spindle 8 is connected to the gearbox 12 (ie is fixed relative to the spindle 8) and is capable of engaging (in the hammer mode) a movable gear 10 fixed to the spindle 8 (ie carried by the spindle 8 during rotation). For this purpose, the ends of the fixed gear 11 and moveable gear 10 are provided with opposing teeth which are meshed in the hammer mode and remote in the drilling mode. Rotation is transmitted from the spindle 8 to the movable gear 10 and (only when the power drill is in the hammer mode) to the fixed gear 11. A spring 13 is disposed on the spindle 8 between the fixed gear 11 and the movable gear 10 which biases the fixed gear 11 and the movable gear 10 apart.

An adjustment member near to the distal end of the housing comprises a rotary adjustment cover 1 connected to an adjustment fork 2. The adjustment fork 2 comprises a ring with three radial arms uniformly distributed around its inner circumference. A washer 23 is deployed to axially install the adjustment fork 2 by aligning the arms with a notch which is formed on the washer 23 and then rotating the washer 23 to a position where the arms are disaligned with the notch so that the adjustment fork 2 is limited on the sleeve 3 and cannot slide away.

A sleeve 3 is rotatably mounted on the spindle 8 and is provided with a groove 7 on its rear end. The front end of the sleeve is provided with a three notches engageable with the three radial arms on the adjustment fork to rotatably couple the rotary adjustment cover with the sleeve 3.

A stroke adjustment member 4 is disposed between the movable gear 10 and the sleeve 3. The stroke adjustment member 4 comprises a ring 4*a* provided with several protruding blocks 9 and three legs 4*b* extending axially from its outer circumference. The stroke adjustment member 4 is freely mounted on the spindle 8 such that the legs extend axially outside the exterior surface of the sleeve 3.

A pressure spring 24 is provided between the stroke adjustment member 4 and the sleeve 3 for biasing them normally apart. To rotate the sleeve 3, the operator rotates the rotary adjustment cover 1 which is connected to the adjustment fork 2 which carries the sleeve 3 and they rotate together around the spindle 8 and align the groove 7 with the protruding block 9. This alignment permits the spindle 8 to be pressed rearwardly thereby carrying the plane bearing 5, washer 23, sleeve 3 and moveable gear 10 and causing the movable gear 10 to engage the fixed gear 11 (ie to adopt the hammer mode). If the groove 7 is not aligned with the protruding block 9, the spindle 8 and the movable gear 10 are not able to be pressed rearwardly and the movable gear 10 is not able to engage the fixed gear 11 so that the drill cannot exert the impact function (ie is in the drilling mode).

A position limiting member 32 having short teeth is fixed on the gearbox 12. The short teeth on the position limiting member 32 produce a click sound when the operator adjusts the rotary adjustment cover 1 to adjust the working mode. A washer 28 mounted within the rotary adjustment cover 1 limits the axial movement of the position limiting member 32. A position limiting plate 21 is mounted on the adjustment cover 1 for limiting the axial position of the sleeve 3. A clamp plate 20 screwed onto the gearbox 12 limits the axial position of the whole structure.

A plane bearing 5 is disposed between the front end of the sleeve 3 and the rear end of the stopper 6. The plane bearing 5 comprises an annular retainer 18 for receiving rolling elements 19. The annular retainer 18 has an annular main body 18*a* containing uniformly distributed pockets 19*a*. A first annular retaining wall 120*a* extends axially from the inner periphery of the annular main body 18*a* and a second annular retaining wall 120*b* extends axially from the outer periphery of the annular main body 18*a*. The outward and inward concavity respectively of the first annular retaining wall 120*a* and the second annular retaining wall 120*b* serve to confine axially the rolling elements 19 such that the axial exterior periphery (parallel to the axis of the spindle 8) of the rolling elements 19 protrudes beyond the exterior periphery of the retainer 18. The rolling elements 19 are able to reduce friction between the rear end of the stopper 6 and the front end 17 of the sleeve. The rolling elements 19 cannot be dislodged even during the reciprocating movement of the spindle 8 in the hammer mode. The radial bounce of the output axle is directly proportional to the ratio L2/(L1+L2) (where L1 is the distance between a rear end 15 of the rear bearing 14 and the front end of the sleeve 3 and L2 is the distance between the front end of the sleeve 3 and the front end 16 of the stopper 6). The present invention represents a big improvement in terms of drill positioning and producing accurate diameter holes by increasing L1 and/or decreasing L2 over the prior art.

What is claimed is:

1. A power drill capable of outputting a torque in a drilling mode or a torque and an impact force in a hammer mode comprising:

a housing having a distal end and a proximal end;

a rotary motor in the housing;

a spindle having a front portion and a rear portion and extending substantially along the longitudinal axis of the housing, wherein a collar on the front portion of the spindle serves as a stopper with a front face and a rear face;

a retaining member located at least in part external to the distal end of the housing and capable of retaining externally a cutting element, where the retaining member is secured to the spindle to be driven therewith and is supported on the front face of the stopper;

a rear bearing mounted on the rear portion of the spindle;

a gearbox mounted within the housing;

a transmission assembly accommodated within the gearbox for coupling the rotary motor with the spindle so as to transmit the rotation of the rotary motor to the spindle;

a fixed gear connected to the gearbox and a movable gear fixed to the spindle, wherein the fixed gear and the movable gear have opposing peripheral teeth which are disengaged in the drilling mode so that the spindle is driven rotationally by the rotary motor to cause the torque force to be outputted to the retaining member and engaged in the hammer mode so that the spindle is driven rotationally and reciprocatively to cause the torque and impact force to be outputted to the retaining member;

an adjustment member mounted on a front portion of the spindle for exteriorly adjusting the power drill between the drilling mode and the hammer mode, the adjustment member comprising a rotary adjustment cover, a sleeve having a front end and a rear end, wherein the sleeve is rotatably mounted on the front portion of the spindle, wherein the rear end of the sleeve is provided with a first engaging portion, an adjustment fork rotatably coupling the rotary adjustment cover with the sleeve and a stroke adjustment member having a front end and a rear end, wherein the stroke adjustment member is mounted on the spindle between the movable gear and the rear end of the sleeve, the stroke adjustment member being provided with a second engaging portion, wherein from the drilling mode the rotary adjustment cover is rotated so that the first engaging portion is aligned axially with the second engaging portion wherefrom the sleeve is pressable rearwardly so that the first engaging portion engages the second engaging portion and the opposing peripheral teeth of the fixed gear and the moveable gear engage into the hammer mode; and a plane bearing coaxially mounted on the spindle between the front end of the sleeve and the rear face of the stopper, the plane bearing comprising:

one or more rolling elements and a substantially annular retainer for retaining the one or more rolling elements having a first axial end and a second axial end, wherein the one or more rolling elements extend axially beyond the first axial end of the retainer.

2. A power drill as claimed in claim 1 wherein the one or more rolling elements extend axially beyond the second axial end of the retainer.

3. A power drill as claimed in claim 1 wherein the retainer includes a first annular retaining wall connected to and positioned coaxially within a second annular retaining wall to confine the one or more rolling elements radially therebetween, wherein either or both of the first annular retaining wall and second annular retaining wall are adapted to confine axially the one or more rolling elements.

4. A power drill as claimed in claim 1 wherein the retainer defines one or more pockets for the one or more rolling elements.

5. A power drill as claimed in claim 4 wherein the retainer comprises an annular main body incorporating the one or more pockets.

6. A power drill as claimed in claim 5 wherein the one or more pockets are a plurality of pockets distributed uniformly around the annular main body.

7. A power drill as claimed in claim 5 wherein the annular main body has an outer circumference and an inner circumference, wherein the first annular retaining wall extends axially from the inner circumference and the second annular retaining wall extends axially from the outer circumference, wherein either or both of the first and second retaining wall are adapted to confine axially the one or more rolling elements.

8. A power drill as claimed in claim 7 wherein the second annular retaining wall is inwardly concave.

9. A power drill as claimed in claim 7 wherein the first annular retaining wall is outwardly concave.

10. A power drill as claimed in claim 1 further comprising a resilient biasing member connected between the stroke adjustment member and the sleeve for biasing them apart.

11. A power drill as claimed in claim 1 wherein the first engaging portion is one or more radial grooves and the second engaging portion is one or more protruding blocks.

12. A power drill comprising: a spindle, a rear bearing mounted on the rear portion of said spindle, a fixed gear with end tooth fixedly connected with a gearbox, a movable gear with end tooth fixedly connected with said spindle, an adjustment member mounted on a front portion of said spindle, said adjustment member comprising an adjustment cover, a fork connected with said adjustment cover, a sleeve connected with said fork, a front interior of said sleeve being slidely contacted with the exterior periphery of said spindle and said sleeve being mounted on said front portion of said spindle, said sleeve being provided with a groove, a stroke adjustment member being disposed between said movable gear with end tooth and said sleeve, said stroke adjustment member being provided with a protruding block, a stopper whose radial dimension is larger than and is disposed on the front portion of the spindle, characterized in that a plane bearing is disposed between the front end of said sleeve and the rear end of said stopper, said plane bearing is provided with a retainer for receiving a rolling element, the exterior periphery of the rolling element protruding beyond the opposite exterior periphery of the retainer.

* * * * *